US007330676B2

(12) United States Patent
Bardolatzy et al.

(10) Patent No.: US 7,330,676 B2
(45) Date of Patent: Feb. 12, 2008

(54) GRAPHICAL USER SURFACE AND METHOD FOR INDICATING A MALFUNCTION STATE OF AN ELECTROPHOTOGRAPHIC PRINTING OR COPYING SYSTEM

(75) Inventors: Ulrich Bardolatzy, Poing (DE); Winfried Krug, München (DE); Nejmi Ölmez, München (DE); Alexander Oszwald, Olching (DE)

(73) Assignee: Oce Printing Systems GmbH, Poing (DE)

( * ) Notice: Subject to any disclaimer, the term of this patent is extended or adjusted under 35 U.S.C. 154(b) by 279 days.

(21) Appl. No.: 10/531,508

(22) PCT Filed: Oct. 27, 2003

(86) PCT No.: PCT/EP03/11907

§ 371 (c)(1),
(2), (4) Date: Jul. 12, 2005

(87) PCT Pub. No.: WO2004/038513

PCT Pub. Date: May 6, 2004

(65) Prior Publication Data

US 2005/0254850 A1 Nov. 17, 2005

(30) Foreign Application Priority Data

Oct. 28, 2002 (DE) ..... 102 50 180

(51) Int. Cl.
*G03G 15/00* (2006.01)

(52) U.S. Cl. ..... 399/81

(58) Field of Classification Search ..... 399/1, 399/8, 11, 18, 24, 27, 81
See application file for complete search history.

(56) References Cited

U.S. PATENT DOCUMENTS 4,586,034 A 4/1986 Nakamine (Continued)

FOREIGN PATENT DOCUMENTS

DE 32 47 871 7/1983

(Continued)

OTHER PUBLICATIONS

Patent Abstracts of Japan—57164749—Oct. 9, 1982.

(Continued)

*Primary Examiner*—Hoang Ngo
(74) *Attorney, Agent, or Firm*—Schiff Hardin LLP

(57) ABSTRACT

In a method or system for display of a malfunction state of a printing or copying system, a display field is substantially shown in a first color in an undisturbed first operating state. The display field is substantially shown in a second color in a potentially disturbed second operating state with a potential malfunction of a first group. The display field is substantially shown in a third color given a disturbed third operating state with a malfunction of a second group. Also a method or system is provided for automatic generation of messages in an electrophotographic printer or copier wherein a text message that contains at least an error code is automatically generated with aid of a data processing system after occurrence of a preset error state. The message is sent to a preset recipient.

24 Claims, 10 Drawing Sheets

U.S. PATENT DOCUMENTS

| | | | | |
|---|---|---|---|---|
| 5,010,551 | A | 4/1991 | Goldsmith et al. | |
| 5,105,220 | A | 4/1992 | Knodt et al. | |
| 5,184,179 | A | 2/1993 | Tarr et al. | |
| 5,414,494 | A | 5/1995 | Aikens et al. | |
| 6,023,593 | A | 2/2000 | Tomidokoro | |
| 6,353,899 | B1 | 3/2002 | Martin et al. | |
| 6,603,937 | B2 * | 8/2003 | Yoshimura et al. | 399/81 |
| 6,842,588 | B2 * | 1/2005 | Haines | 399/8 |
| 2001/0028473 | A1 | 10/2001 | Yamasaki et al. | |
| 2002/0046274 | A1 | 4/2002 | Motoyama | |
| 2002/0056015 | A1 | 5/2002 | Nakai et al. | |
| 2002/0097422 | A1 | 7/2002 | Matthews et al. | |

FOREIGN PATENT DOCUMENTS

| | | |
|---|---|---|
| DE | 196 04 323 | 8/1996 |
| DE | 101 46 335 | 5/2002 |
| EP | 0 699 966 | 3/1996 |
| EP | 1 109 395 | 6/2001 |
| EP | 1 179 432 | 2/2002 |
| EP | 1 205 816 | 5/2002 |
| FR | 2 695 236 | 8/1993 |
| JP | 2001-235980 | 8/2000 |
| JP | 2002-008922 | 1/2002 |
| WO | WO 02/46971 | 6/2002 |

OTHER PUBLICATIONS

Xerox Disclosure Journal—vol. 14, No. 1 Jan./Feb. 1989 p. 25.

* cited by examiner

| | Symbol | Description |
|---|---|---|
| 1 | | If no error is present in the printing system (image), the icon is shown deactivated in a greyscale representation. In the case of an error, for example given a paper jam, the icon blinks, in that the icon is alternately shown red and grey. Upon pressing the graphical function key that is stored with the icon, the "errors and warnings" menu is invoked and displayed. |
| 2 | | If no warning is present in the printing system (image), the icon is shown deactivated in a greyscale representation. In the case of one or more warnings, the icon blinks, in that the icon is alternately shown yellow and grey. Upon pressing the graphical function key that is stored with the icon, the "errors and Warnings" menu is invoked and displayed. |

FIG. 9

| Row | Symbol | Description |
|---|---|---|
| 1 | | Overall view of printer. |
| 2 | | Enlarge the current printer view. |
| 3 | | Shrink the current printer view. |
| 4 | | Shift the printer view in the respective direction of the arrow. |
| 5 | | Display the service ticket instead of the printer view. Return to the previous state via the same button. |
| 6 | | Display the detailed description for this error / this warning instead of the menu tree.<br>Return to the previous state via the same button. |
| 7 | | Change to the next / preceding error / warning. |
| 8 | | Change the view between:<br>• List without printer view<br>• List with printer view<br>• Printer view without list |

FIG. 10

GRAPHICAL USER SURFACE AND METHOD FOR INDICATING A MALFUNCTION STATE OF AN ELECTROPHOTOGRAPHIC PRINTING OR COPYING SYSTEM

BACKGROUND

The preferred embodiment concerns a graphical user interface and a method for indication of a malfunction state of an electrophotographic printing or copying system. The preferred embodiment also concerns a graphical user interface and a method for support in the correction of an error state of an electrophotographic printing or copying system and a system as well as a method for automatic generation of messages in an electrophotographic printer or copier.

Known electrophotographic printing or copying systems contain operating units with display and input units via which user interfaces are displayed. If an error state occurs, a text message is output (typically with an error code) that informs an operating personnel about the occurrence of the error. The error messages have preferably been displayed with the aid of an error list, what is known as the error journal or error list, in which messages of a plurality of occurred errors can be stored. An operating personnel could then determine the error cause and initiate steps for error remedy with the aid of manuals or via a telephone call to a service center of the printer or copier manufacturer. The call number of such a service center of the printer or copier manufacturer was specified in the manual of the printer or copier.

After the exchange of an expendable part and after the filling of consumable materials in a known printing or copying system, a new replacement expendable part or new consumable material is re-ordered by filling out an order form that is then sent to the service center of the printer or copier manufacturer via fax or postal service.

A display device for a copying device is known from the document DE 32 47 871 A1, in which patterns or diagrams are printed out on a display panel, whereby these patterns or diagrams are displayed through a color filter with a light source arranged behind them upon occurrence of a malfunction state. Given activation of the light source, individual elements can be displayed in the color "yellow" and other elements can be displayed in the color "red".

Furthermore, from the document DE 101 46 335 A1 it is known to provide a multimedia user interface in a printer or copier. With the aid of the multimedia user interface, information about the functioning of the control of the printer or copier can be output to a user. The user interface also serves to support an operating personnel in the correction of an error state.

From the document FR 2 695 236 A1, a method is known for display of machine malfunctions of a polygraphic machine via which a fast discovery and remedy of machine malfunctions is possible with the help of image representations or a series of real images.

A system for determination of the exchange of a component in a printer is known from the document DE 101 46 335 A1, in which the printer sends a component exchange notice to a computer connected over a network. This computer can then, for example, send a fax with an order/information to a vendor.

A system with a plurality of printers or copiers is known from the document U.S. Pat. No. 6,023,593, in which consumable materials can be ordered at a supplier with the aid of a central controller. With the help of a data communication device, the individual printers or copiers are queried in order to determine the need for consumable materials.

A monitoring and accounting system in a printer or copier is known from the document U.S. Pat. No. 5,184,179. The monitoring and accounting occurs with the aid of number values that are recorded by a counter in the printer or copier.

A display field of a copier in which error states are represented by showing the display element in the color yellow or red is known from the document U.S. Pat. No. 4,586,034 A. However, a display element can only be shown in one color, whereby a concise error representation is difficult.

An operating unit that contains display elements that contain a red lamp and a green lamp is known from the Patent Abstract of Japan for application 2000-046461. However, only one error state can be indicated in this operating unit.

From the document EP 0 699 966 A2 it is known to use a sequence of images as an aid for error correction, which images show the actions to be taken in series in order to arrive at the error location.

From the document U.S. 2002/0079422 A1, a user interface is known with what are known as selection buttons that contain schematic representations of selected structural units. By activating such a selection button, detailed information regarding the occurred error is shown in a display window.

SUMMARY

It is an object to specify a graphical user interface, a system and a method for an electrophotographic printing or copying system with which a simple and fast error correction is possible and operator control actions for request of consumable materials and expendable parts as well as a malfunction notification are simplified.

In a method or system for display of a malfunction state of a printing or copying system, a display field is substantially shown in a first color in an undisturbed first operating state. The display field is substantially shown in a second color in a potentially disturbed second operating state with a potential malfunction of a first group. The display field is substantially shown in a third color given a disturbed third operating state with a malfunction of a second group. Also a method or system is provided for automatic generation of messages in an electrophotographic printer or copier wherein a text message that contains at least an error code is automatically generated with aid of a data processing system after occurrence of a preset error state. The message is sent to a preset recipient.

BRIEF DESCRIPTION OF THE DRAWINGS

FIG. 9 is an explanation of the display field of a malfunction indication and of a warning indication that are contained in the user interfaces according to FIGS. 1 through 8; and FIG. 10 is an explanation of the symbols for control of the views to determine the error cause, which symbols are contained in the user interfaces according to FIGS. 1 through 8.

DESCRIPTION OF THE PREFERRED EMBODIMENT

Figure 1:
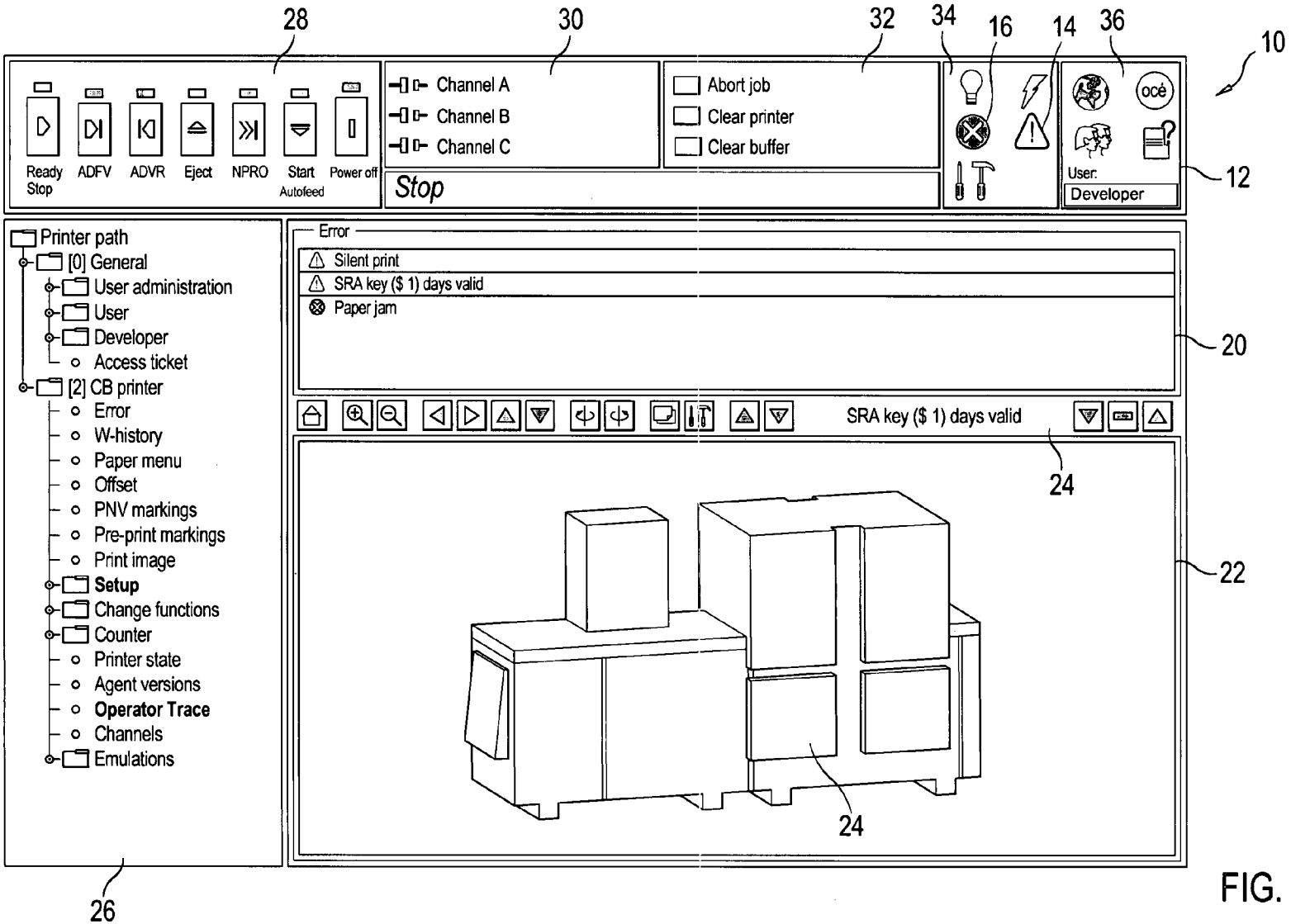
FIG. 1 is a graphical user interface for indication by an operating unit of an electrophotographic printing system according to a first exemplary embodiment of the invention.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

Errors and potential malfunctions or warnings are signaled to an operating personnel via a color, variable display field via a graphical user interface. Malfunctions are in particular error states of the electrophotographic printer printing or copying system. An operating personnel thus immediately recognizes, i.e. at a glance, that the electrophotographic printing or copying system is in an undisturbed operating state, in an operating state with a malfunction or in an operating state with a potential malfunction, in particular in an alarm or warning state. The operating personnel can thereby furthermore quickly and specifically take measures for error correction and minimize the effect of a malfunction. The operating personnel can thus, for example, forward print jobs to other printing or copying systems.

A second aspect of the preferred embodiment concerns a method to indicate a malfunction state of an electrophotographic printing or copying system. With the help of such a method, an operating personnel can quickly and simply obtain information about the operating state of the electrophotographic printing or copying system, whereby the operating personnel can immediately take further steps for malfunction correction or to prevent a malfunction.

A third aspect of the preferred embodiment concerns a graphical user interface for support in the correction of an error state of an electrophotographic printing or copying system. Given the occurrence of an error state, i.e. given occurrence of a malfunction or a potential malfunction, a first graphic representation of at least one view of the printing or copying system is output with the aid of the graphical user interface. The region is thereby specified in which an occur has occurred. Furthermore, a second graphic representation can be output in which the error location is shown enlarged and/or more detailed in contrast with the first graphic representation. An operating personnel or a service technician is thereby given a precise aid in finding the error location. The error cause can thereby be quickly and specifically remedied. Furthermore, the at least two views that serve for indications for finding the error location and thus for fast remedy of the error state can be switched between.

A fourth aspect of the preferred embodiment concerns a method for support in the correction of an error state of an electrophotographic printing or copying system. Given an error state, at least one first graphical representation of at least one view of the printing or copying system in which the error state has occurred is output. At least one second graphical representation is subsequently output via which at least one enlarged or a more detailed representation of the error location occurs. An operating personnel can thereby be guided step-by-step to the error location. Long delays in the finding of the error cause are thus prevented. The operating personnel receives more detailed information for finding the error location with the aid of the views. The error location can thereby also be the location at which the error can be corrected.

A fifth aspect of the preferred embodiment concerns a system for automatic generation of notices in the electrophotographic printer or copier. The system contains a data processing system that generates at least one text message upon occurrence of a pre-set event. For example, malfunction messages, re-orders of expendable parts and of consumable materials can thereby be generated without further operator control actions of an operating personnel. Error causes such as the specification of wrong order numbers are prevented by the automatic generation of the message by the data processing system. Given occurred malfunctions, all data necessary to determine the malfunction cause can be contained in the automatically-created text notification.

A sixth aspect of the preferred embodiment concerns a method for automatic generation of notifications in an electrophotographic printer or copier. After the occurrence of a preset event, a text message that contains specifications about the event is automatically generated with the aid of a data processing system of the printer or copier. The message is sent to a preset receiver. It is thereby achieved that messages are generated in a simple manner, whereby an operating personnel is unburdened and errors are prevented.

A first graphical user interface 10 according to a first exemplary embodiment is shown in FIG. 1. The graphical user interface 10 contains a first section 12 with display fields and graphical function keys, what are known as buttons. The section 12 is also designated as a toolbar.

A first display field in the section 12 is designated with 14. This display field 14 is activated after the occurrence of a potential malfunction, for example when the toner reservoir or the paper reservoir of the printing system drops below a specific value or when consumable counters overrun or underrun a specific number value. In the deactivated state, the display field 14 is shown in a grey tone that optically stands out with only a low contrast from the background of the section 12. The display field 14 is activated after the occurrence of an error, such that the display field 14 is essentially colored in a yellow color, whereby a relatively strong contrast with the background of the section 12 is created. The exclamation mark in the center of the display field is furthermore shown black.

A second display field 16 is activated after the occurrence of a malfunction. Similar to the display field 14, the display field 16 is shown in a grey tone in the deactivated state. The cross arranged in the center of the display field 16 is thereby shown in a white color. In a normal operating state in which no malfunction has occurred, the display field 16 thus does not prominently catch the eye of an operating personnel.

After the occurrence of a malfunction, the display field 16 is significantly colored in a red color that is significantly high-contrast relative to the background of the section 12. The display field 16 is thereby optically strongly emphasized in the section 12. An operating personnel is thus very quickly and clearly informed about the operating state of the printing system. The display field 14 also has a triangular shape and the display field 16 has a round shape for differentiation of the warning state and the malfunction state.

The section 12 furthermore contains a field 18 for text output in which the current operating state is output as text. Thus, after the occurrence of a malfunction state the display field 16 is activated and the text "stop" is output in the text output field. If only the display field 14 is activated, dependent on the cause of the potential malfunction the text "warning" or "alarm" is output in the text output field 18. Both the display field 14 and the display field 16 are activated in the representation according to FIG. 1. The malfunction notification has a higher priority than the message of a potential malfunction, such that after two warnings and a malfunction have occurred the text "stop" is output in the text output field 18.

A list with malfunction messages and warnings, what is known as the error list, is also output in a second section 20 of the graphical user interface 10 after the occurrence of an error. Two warnings and a malfunction are currently contained in the error list. For clear association with the message, the symbols of the display fields 14 and 16 are prefixed to the respective message, whereby the symbol of the display field 14 is prefixed to warnings and alarm messages and the symbol of the display field 16 is prefixed to malfunction messages.

At least one detailed item of information about the error message, i.e. about the warning or the malfunction message, is output in the third section 22 via the selection of an error message in the second section 20 of the user interface 10. The third section 22 contains a separate toolbar 24 that contains graphical function keys and a text output field. The error message selected in the second section 20 is output in the text output field, whereby with the aid of the graphical function keys selection can be made between a text output mode with indications of the error cause and with data that are necessary to determine the error cause and at least one graphical representation of the printing system with an indication of the error cause.

A graphical representation of the back side of the printing system is shown in the third section 22 in FIG. 1, since an operating personnel only has access to the error location from this side of the printing system. Furthermore, a flap 24 to be opened is optically emphasized in this graphical representation. This flap 24 must be opened to reach the error location. The operating personnel thereby receives a precise instruction as to how he or she at least arrives at the error location. Further views that also contain information to remedy the error cause can be selected with the aid of the function keys of the toolbar 24. In further views of the printer, the third section 22 of the user interface 10 also contains text information, animated graphics and/or video sequences for remedy of the error cause.

The graphical user interface 10 furthermore contains a menu 26 in which various user interfaces can be selected. Setting values and parameters of the printing system can be changed and/or read out with the help of these user interfaces. The toolbar in the first section 12 contains further display fields and function keys. Thus in region 28 the toolbar contains graphical function keys for operation of the printing system that are also provided in hardware as buttons on the printing system. The graphical function keys in the region 28 optically coincide in shape, color and arrangement with the keys present on the printing system.

A printing channel of the printing system can be selected in the region 30 of the toolbar, whereby the activated channel is optically emphasized in the region 30. Existing print jobs can be aborted in the region 32 by an operating personnel, for example after a malfunction. Further display fields and function keys as well as a text output field with the display of the currently set user are contained in the regions 34 and 36 of the toolbar. The display fields 14 and 16 contained in the region 34 have already been described in detail further above. The graphical function keys of the toolbar 24 and the display fields 14 and 16 are specified in further detail in connection with FIGS. 9 and 10.

Figure 2:
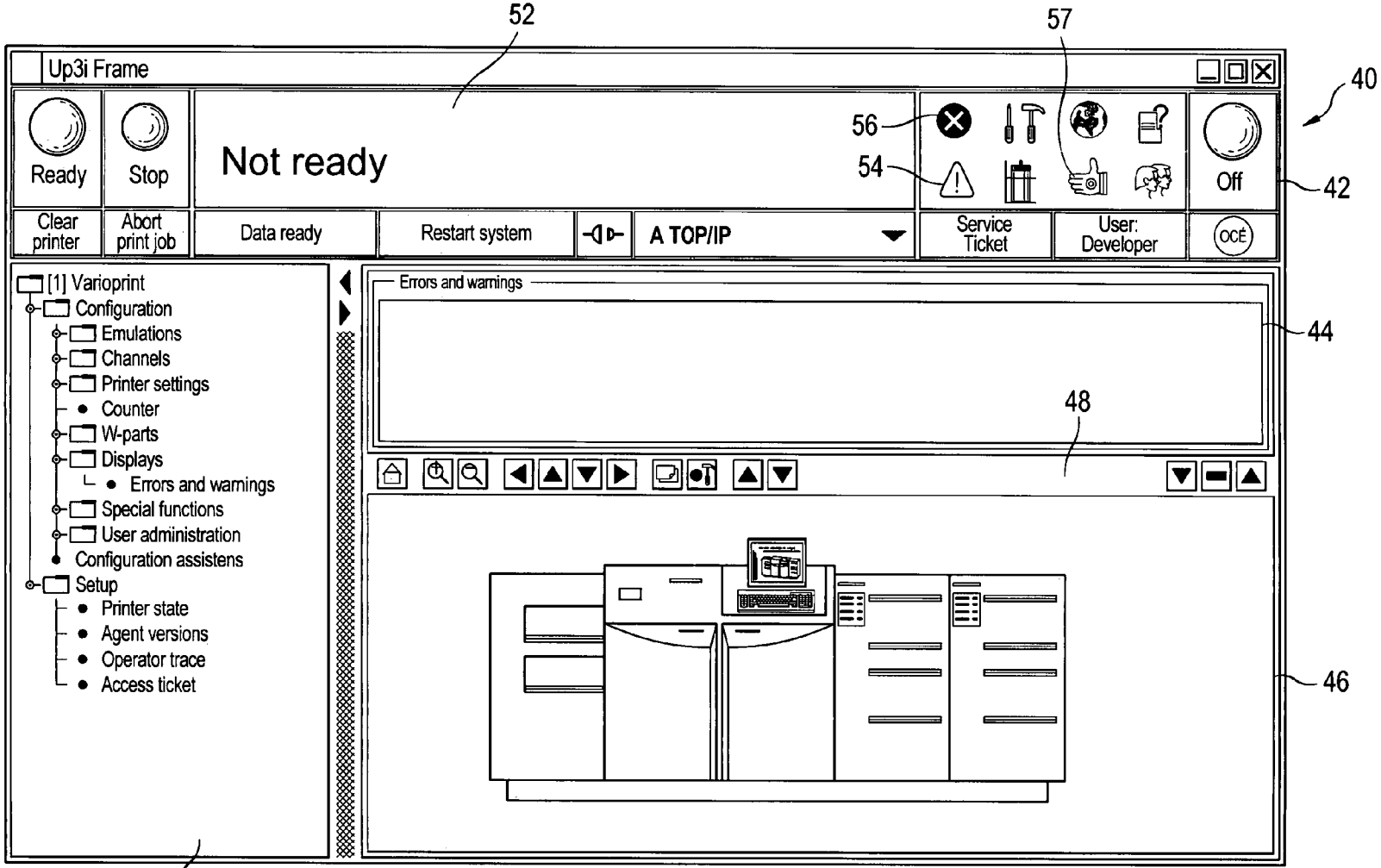
FIG. 2 is a graphical user interface for indication by an operating unit of an electrophotographic printing system according to a second exemplary embodiment of the invention.

A graphical user interface 40 according to a second exemplary embodiment is shown in FIG. 2. Like the user interface 10 according to FIG. 1, the user interface 30 according to FIG. 2 has a first section 42 that contains a toolbar. A second section 44 of the graphical user interface 40 contains an output of error messages and warnings, similar to the second section 20 of the graphical user interface 10 according to FIG. 1. A third section 46 of the graphical user interface 40 contains a toolbar 48, whereby a graphic representation of the printing system via which an operating personnel receives an indication of the error cause and/or the error location is given in the third section 46. Detail views of the printing system with the error location and/or views to reach the error location can be selected and called up with the aid of the graphical function keys of the toolbar 48.

The graphical user interface 40 furthermore contains a menu 50 with which can be called up the user interfaces that can be displayed in the regions 44 and 46. After the occurrence of an error state, i.e. a malfunction, and upon occurrence of a potential malfunction, for example a warning or an alarm state, instead of the control panel selected in the menu 50 the error list is displayed in the second section 44 and detail information regarding the malfunction is shown in the section 46.

The toolbar 42 contains a plurality of graphical function keys to control the printing system such as, for example, a stop button, a "ready" button and an "off" button, whereby these buttons respectively contain a display element that displays the operating state of the respective button or of the printing system. The toolbar 42 contains further graphical function keys for the control of print data and a selected print channel. The current status or the current operating state of the printing system is output in a text output field 52, whereby the background color of the text output field 52 is changed dependent on the operating state of the printing system. The background color is thus red given the state "not ready" and green given the operating states "ready" or "in operation". The toolbar 42 furthermore contains a display field 54 for display of potential malfunctions, i.e. warnings and alarm messages, and a display field for display of malfunction states. The activation of the display field 54 occurs essentially like the activation of the display field 14 according to FIG. 1, and the activation of the display field 56 occurs essentially as described in connection with the display field 16 according to FIG. 1.

The graphical user interface 40 is provided for an operation with the aid of a computer mouse or a comparable pointer device. The graphical user interface 40 is thus suitable for operation with the aid of computer mice, trackballs or for stylus input given touch-sensitive screens, what are known as touchscreens. The selection of individual function keys or menu entries thereby occurs in that the pointer device or a pointer guided by the pointer device is positioned over the respective menu entry or the respective function key and is selected or activated via a further operator control action, for example via what is known as a mouse click. The toolbar 42 contains a function key 57, whereby given an activation of this function key 57 the graphical user interface 40 is switched to a user interface 60 shown in FIGS. 4 and 5 that is in particular suitable for "finger operation" via a touch-sensitive screen.

Figure 3:
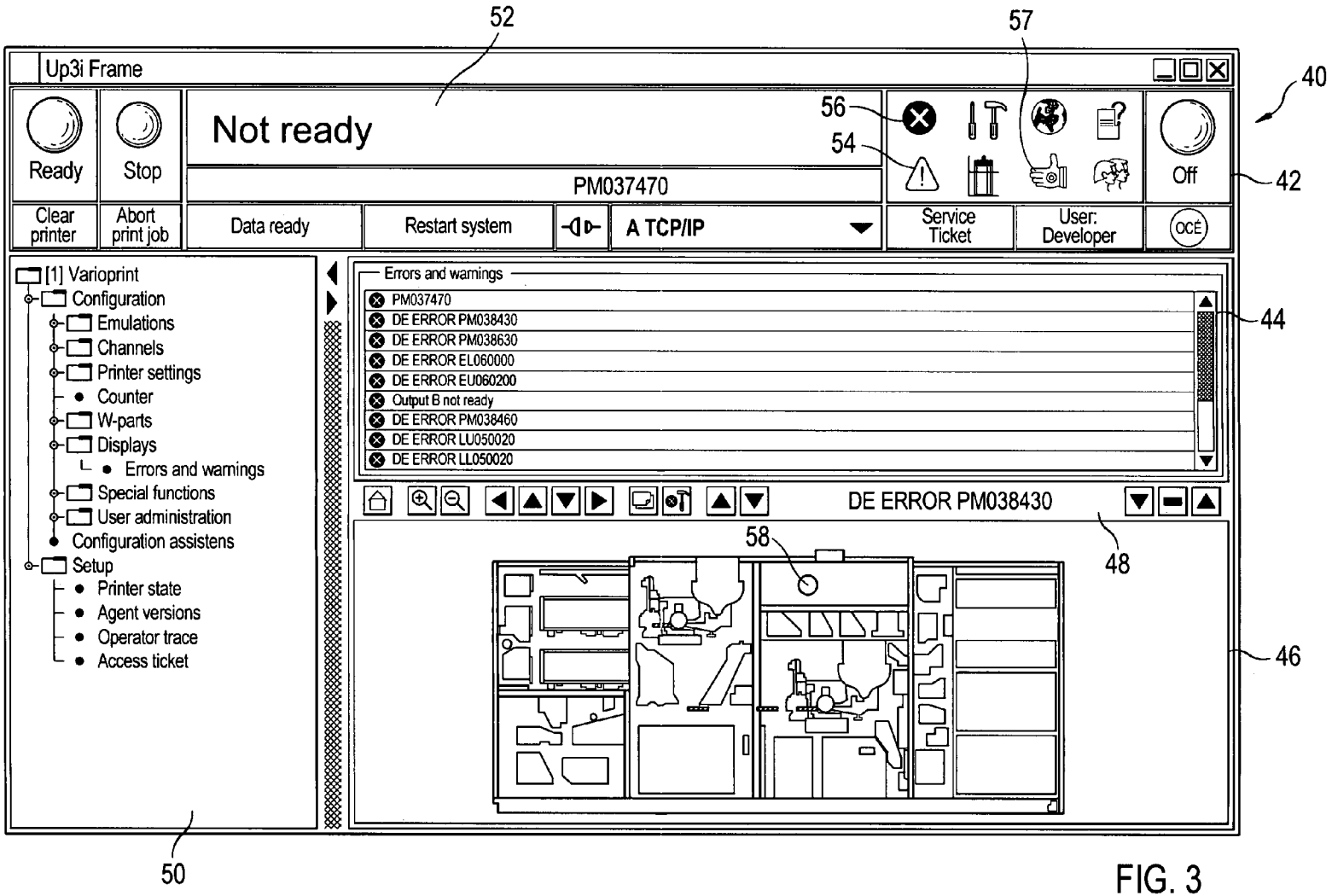
FIG. 3 shows the graphical user interface according to FIG. 2 with a second representation of the printing system.

The user interface 40 according to FIG. 2 is shown in FIG. 3, in which an error list with malfunction messages and warning is displayed in the display field 44 and a detail view of the printing unit is displayed in the display field 46, via which detail view an operating personnel receives an indication in order to arrive at the error location. The detail view of the printing system in the section 46 contains a display field 58 with a symbol that is similar to the symbol of the display field 56 for a malfunction message. Via the positioning of the display field 58 on the detail view in the section 46, the operating personnel furthermore receives an indication that the error search must be continued at this location in order to arrive at the error site, i.e. at the site at which a correction of the error can be implemented.

In the present exemplary embodiment, a further flap of the printing system that has been marked by the display field 58 is to be opened. This display of the instruction for finding the error location concerns the error with the designation "DE ERROR PM038430". If the graphical user interface 40 displays a different error in the error list in the section 44, a detail view of the printing system suitable for this error is shown in the section 46, whereby this representation then contains an instruction for finding the error location. The other elements of the user interface 40 coincide with the elements of the user interface 40 shown in FIG. 2. In other exemplary embodiments, instead of the error codes shown in FIGS. 2 and 3 a preset text stored in the operating unit is output (i.e. displayed) both in the error list in section 44 and in the display field of the toolbar 48.

Figure 4:
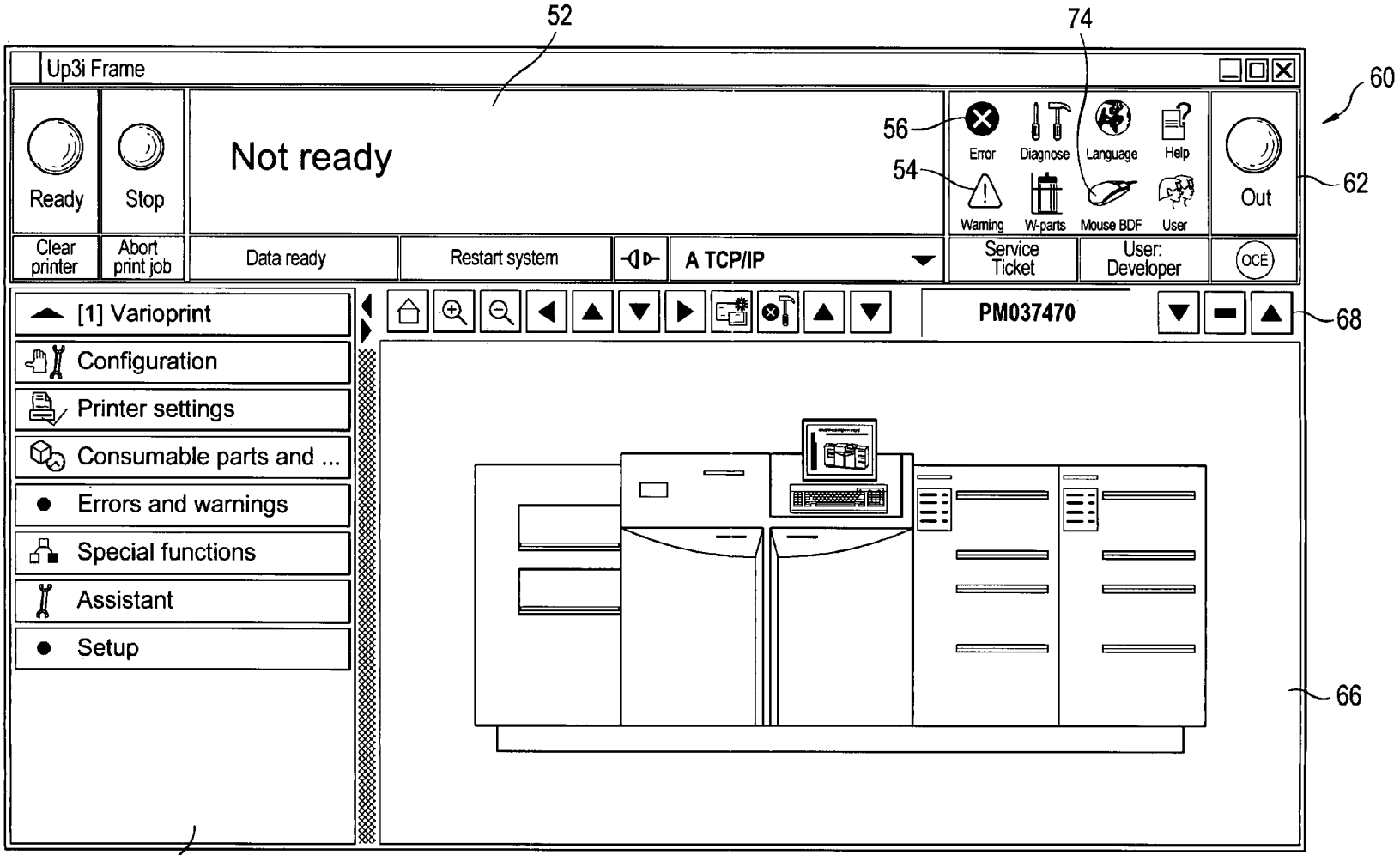
FIG. 4 is a graphical user interface similar to the user interfaces according to FIG. 2.

A graphical user interface 60 similar to the user interface 40 according to FIG. 2 is shown in FIG. 4. The user interface 60 according to FIG. 4 has been optimized for what is known as the finger operation of a touch-sensitive screen. In contrast to the user interface 40 according to FIG. 2, the activation areas associated with the individual function keys and menu entries have been enlarged such that, given input via a finger contact, it is ensured that adjacent function keys or menu entries are absolutely not selected as well. A toolbar 62 contains the display fields and function keys that are contained in the section 42 of the graphical user interface 40 according to FIG. 2. The functions essentially coincide with the function keys and output fields shown there. The output of a section with an error list similar to the section 44 according to FIG. 2 has been omitted in the graphical user interface 60 according to FIG. 4 for space reasons. The space of the section 44 of the graphical user interface 2 has been used in the graphical user interface 60 according to FIG. 4 in order to show the section 66 and the section 62 on a larger area. The section 66 contains a toolbar 68 with function keys via which a plurality of error messages containing error lists (not shown in this view) can be switched between in order to obtain detail information regarding these errors, which information is then shown in the section 66 as a graphical representation and/or as a text output.

Furthermore, the graphical user interface 60 contains a menu 70. In contrast to the menu 50 according to FIG. 2, the menu 70 contains a reduced number of menu entries in which not as many menu branches of the present menu tree are shown. However, the individual menu entries of the menu 50 are associated with significantly larger activation areas, whereby a selection of a menu entry can occur with the aid of a finger input via a touch-sensitive screen without accidentally selecting the adjacent menu entries or simultaneously selecting a plurality of menu entries.

Figure 5:
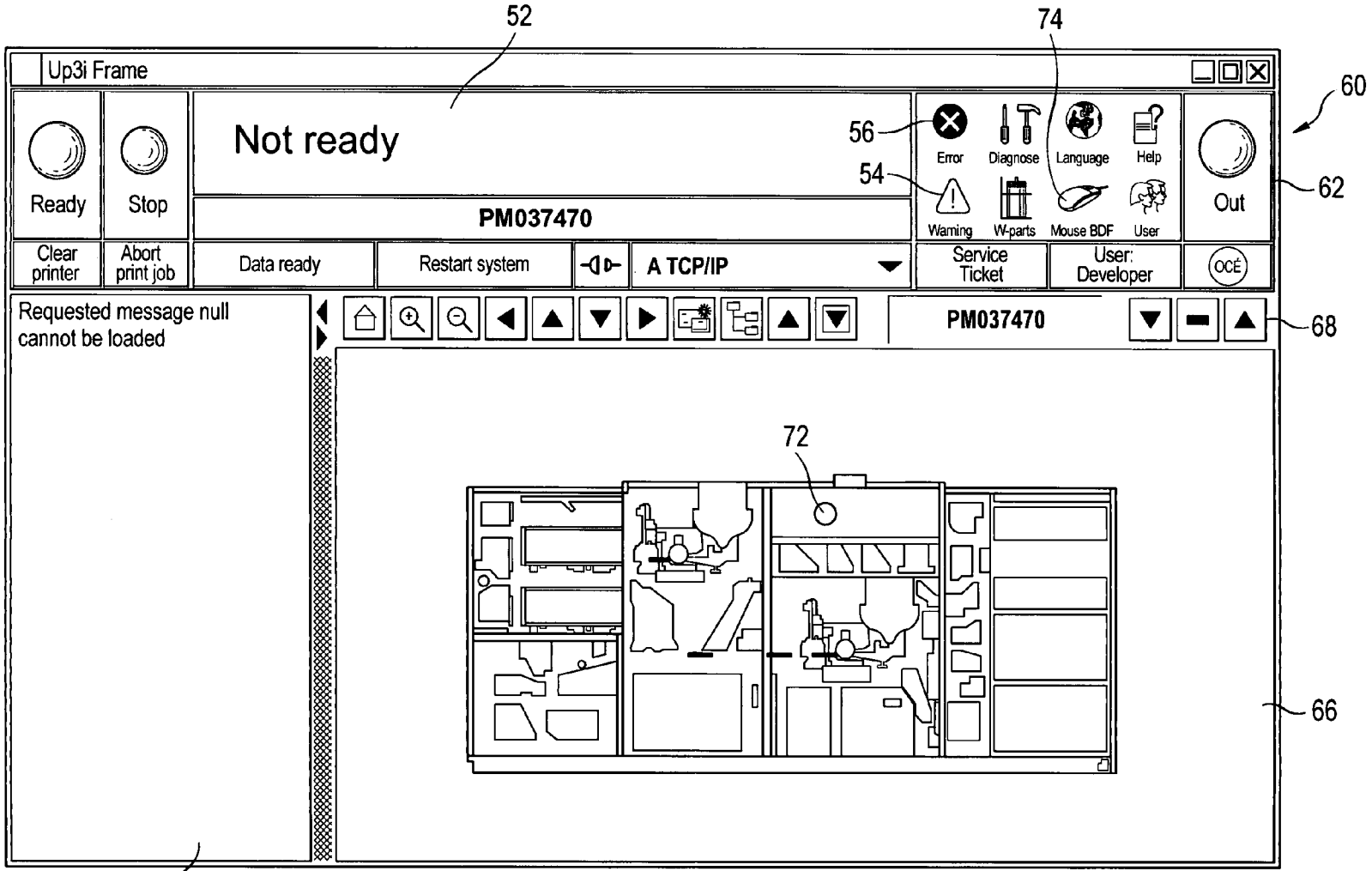
FIG. 5 shows the user interface according to FIG. 4 with a second representation of the printing system.

The graphical user interface 60 according to FIG. 4 is shown in FIG. 5, whereby a detail view of the printing system is shown in section 66. The detail view significantly coincides with the detail view of the printing system shown in FIG. 3. The error PM037470 was selected (with the aid of the function keys in the toolbar 68) from the error list not shown in the graphical user interface 60, whereby the detail view of the printing system shown in section 66 in particular receives an instruction for reaching the error site, in particular with the help of a display element 72.

With the aid of the function key 74, the user interface 40 can be switched to the representation according to FIG. 3. With the help of the function key 56 in the toolbar, it can be switched again to the graphical user interface 60. As already mentioned in connection with FIGS. 1 through 3, the symbols of the toolbar 68 as well as the meaning of the representation of the display fields for errors and warnings are explained in further detail in connection with FIGS. 9 and 10.

Figure 6:
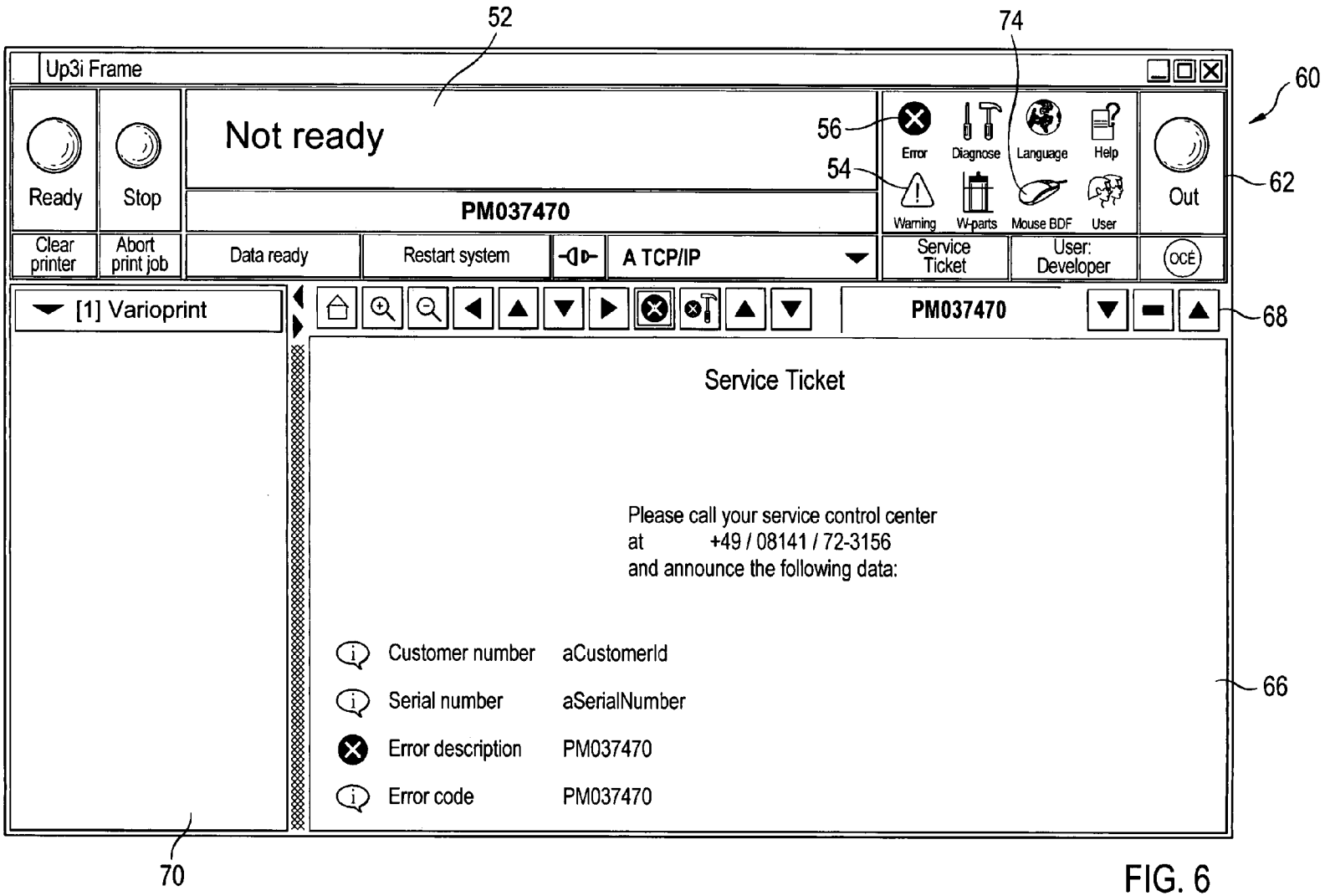
FIG. 6 shows the graphical user interface according to FIGS. 4 and 5, whereby text message is output.

The user interface 60 according to FIGS. 4 and 5 is shown in FIG. 6, whereby what is known as a service ticket has been requested with the aid of a function key of the toolbar 68. A text output with error-relevant information occurs via the service ticket. The service ticket according to FIG. 6 thus contains a customer number, a serial number of the printing system, an error description and an error code.

Furthermore, the service ticket contains information as to how to further proceed when the operating personnel cannot himself remedy the error. In the present case, the service ticket shown in section 66 contains the instruction that the operating personnel should call a service control center, whereby the telephone number of the service control center is specified. In the present case, the operating personnel receives via this service ticket information as to where further information is to be obtained, namely from service technicians in the service control center. All information necessary for error description are displayed in the section 66 and are thus immediately available for the operating personnel upon making contact with the service control center. Given other errors, the service ticket can also contain concrete instructions for operator control actions for error correction.

Figure 7:
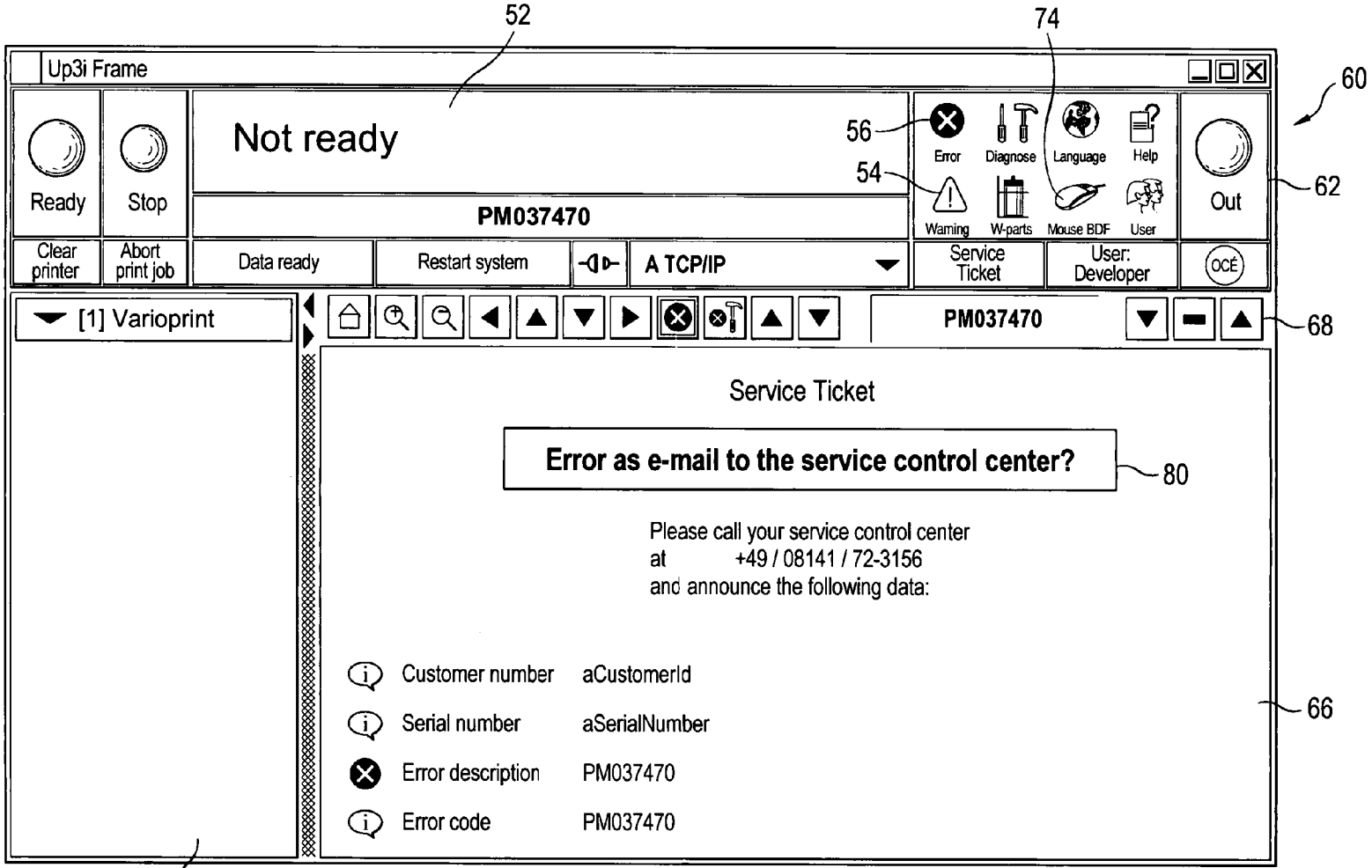
FIG. 7 shows the user interface according to FIGS. 4 through 6, whereby a message with error information about an occurred error state has been automatically generated.

The graphical user interface 60 with the service ticket (shown in FIG. 6) for the error PM037470 is shown in FIG. 7. In the user interface 60 according to FIG. 7, it is pre-set that an e-mail notification is automatically generated upon invocation of a service ticket. In addition to the information that is contained in the service ticket, an input and output field 80 is also contained in the section 66. The input and output field 80 contains the text message "Error as e-mail to the service control center?" Via selection of this input and output field by an operating personnel, the generated e-mail notification is automatically sent to a preset e-mail address of the service control center.

Figure 8:
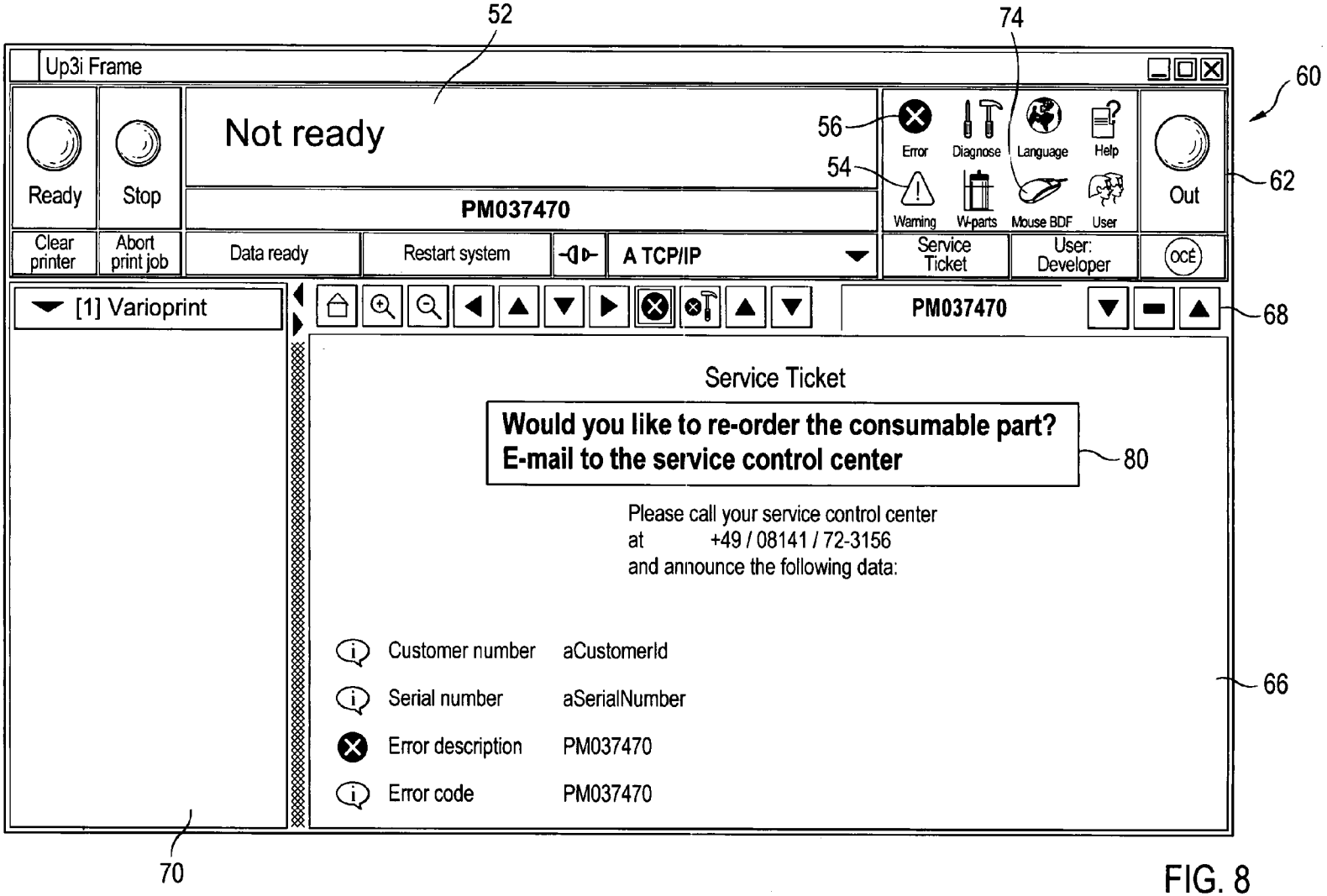
FIG. 8 shows the user interface according to FIGS. 4 through 7, whereby a message for re-ordering of an expendable part has been automatically generated.

The user interface 60 is shown in FIG. 8 with a second service ticket. The second service ticket according to FIG. 8 contains information for re-order of an exchanged consumable part and/or of consumable material. After the exchange of a consumable/expendable part and/or after the re-filling of the consumable material, a service ticket is automatically generated that is shown in window 66. Furthermore, an e-mail notification is generated that essentially contains the information of the displayed service ticket and that can be sent to a preset e-mail address. To send this e-mail, an operating personnel must activate a button 82 that contains a text field with the text output "Would you like to re-order the consumable part? E-mail to the service control center". Via activation of the button 82, this e-mail message is automatically sent and the exchanged consumable part and/or consumable material is re-ordered.

A table for explanation of the display fields 14 and 16 or 54 and 56 is shown in FIG. 9. As already explained in connection with FIGS. 1 through 8, the display field 14, 54 serves to signal a potential malfunction such as, for example, to signal an alarm state or a warning. If the printing system is located in a normal operating state, i.e. no alarm state or no warning exists, the display field 14, 54 (shown as a symbol which is also designated as an icon) is displayed in a deactivated state, i.e. in a greyscale representation. If the printing system is located in an operating state in which a potential malfunction exists, such as, for example, an alarm state or a warning, the display field is displayed in a blinking type of representation in which the display field is alternately shown essentially yellow and essentially grey. Upon activation of the graphical function key that is lodged in the display field, the error menu and warning menu (what are known as the error lists) are recalled and displayed.

The display fields 16, 56 contain a shape and design that are designated as what is known as an icon. The display field is displayed deactivated in a greyscale representation in a first, undisturbed state. In the event of an error, i.e. after the occurrence of a malfunction such as, for example, given a paper jam, the display field is displayed in a blinking representation in which the display field 16, 56 is alternately shown essentially red and essentially grey. The error list is recalled and displayed via activation of the graphical function key that is lodged in the display field 16, 56.

A table is shown in FIG. 10 in which the symbols of the toolbars 24 and 68 are described. A graphical function key via which the action designated with the description in the column of the same row is executed are respectively stored with the symbols. An overall view of the printing system is shown in the window 22 or 46, 66 via activation of the symbol shown in row 1. The current printing system view is enlarged via activation of the symbol in row 2. The current view of the printing system is shown shrunk with the aid of the symbol shown in row 3.

The view of the printing system can be shifted in the respective direction of the arrow shown by the symbol with the aid of the function keys stored with the symbols according to row 4. A service ticket can be displayed instead of the view of the printing system via the symbol in row 5. The return to the preceding view occurs via repeated activation of the function key stored with the symbol in row 5.

A detailed description of a selected error is output in the section 22, 46, 66 of the respective graphical user interface 20, 40, 60 via activation of the function key stored with the symbol in row 6. Via repeated activation of the same function key, the display of the detailed description is ended.

With the aid of the function keys associated with the symbols shown in row 7, the next or a preceding error in the series in the error list can be changed to. A change of the representation type can occur with the aid of the function keys associated with the symbols shown in row 8. Thus a representation of the error list without a printing system view, a representation of the error list with a printing system view and a printing system view without error list can be changed between with the aid of the function keys.

Although preferred exemplary embodiments are shown and described in detail in the drawings and the present specification, this should be viewed as purely exemplary and not as limiting the invention. It is noted that only the preferred exemplary embodiments are shown and described, and all variations and modifications that presently and in the future lie within the scope of protection of the invention should be protected.

We claim as our invention:

1. A graphical user interface for indication of a malfunction state of a printing or copying system, comprising:

at least one display field for malfunction indication, the display field being substantially shown in a first color given an undisturbed first operating state;

the display field providing a warning graphical symbol, and the display field being substantially shown in a second color given a potentially disturbed second operating state with a potential malfunction of a first group which has not yet occurred; and the display field providing a malfunction graphical symbol different than the warning symbol, and the display field being substantially shown in a third color given a disturbed third operating state with a malfunction of a second group which has already occurred.

2. A user interface according to claim 1 wherein the first color comprises a low-contrast color relative to surroundings of the display field.

3. A user interface according to claim 1 wherein the second color comprises a color that is clearly distinguishable from surroundings of the display field, and a warning message being output in the second operating state.

4. A user interface according to claim 1 wherein the third color comprises a color that is clearly distinguishable from surroundings of the display field, and a malfunction message being output in the third operating state.

5. A user interface according to claim 1 wherein the second group comprises malfunctions in which an error state exists due to which at least one of the functions selected from the group consisting of a severe impairment of the printing or copying system exists and a printing or copying process is interrupted.

6. A graphical user interface for display of a malfunction state of a printing or copying system, comprising:

a warning graphical symbol and a malfunction graphical symbol different than the warning graphical symbol;

the warning and malfunction graphical symbols being substantially shown in a first color given an undisturbed first operating state;

the warning graphical symbol being substantially shown in a second color and the malfunction graphical symbol being substantially shown in the first color given a potentially disturbed second operating state with a potential malfunction of a first group which has not yet occurred; and the malfunction graphical symbol being substantially shown in a third color given a disturbed third operating state with a malfunction of a second group which has already occurred.

7. A method for display of a malfunction state of a printing or copying system, comprising the steps of:

showing a display field substantially in a first color in an undisturbed first operating state;

providing a warning graphical symbol with the display field, and showing the display field substantially in a second color as a warning in a potentially disturbed second operating state with a potential malfunction of a first group which has not yet occurred; and providing a malfunction graphical symbol different than the warning symbol with the display field, and showing the display field substantially in a third color given a disturbed third operating state with a malfunction of a second group which has already occurred.

8. A graphical user interface for support in a remedy of an error state of an electrophotographic printing or copying system, comprising:

at least one first graphical representation of at least one first view of the printing or copying system, the graphical representation specifying a region in which an error has occurred;

at least one second graphical representation of at least one part of the first representation in which a location of the error is shown enlarged compared to the first graphical representation of the region in which the error has occurred; and activation of a function for the enlarging occurring via an input.

9. A user interface according to claim 8 wherein at least the second graphical representation contains an indication of accessibility of the error location.

10. A user interface according to claim 8 wherein at least one of the first and second representations is a three-dimensional representation.

11. A user interface according to claim 8 wherein at least one of the first and second views is contained in an image series of at least one of an animated graphic or a film sequence.

12. A user interface according to claim 8 wherein the second graphical representation is generated from the first graphical representation with aid of the enlarging function.

13. A user interface according to claim 8 wherein in addition to at least one of the first and second graphical representations, the graphical user interface contains text via which an operating personnel receives an indication of accessibility of at least one of the error location and a cause of the error.

14. A user interface according to claim 8 wherein at least one of the first and the second graphical representations contains at least one region of a housing side of the printing or copying system from which an access to the error location is possible.

15. A method for support in a remedy of an error state of a printing or copying system, comprising the steps of:

given an error state, outputting at least one first graphical representation of at least one view of the printing or copying system in which a region of the printing or copying system in which the error state has occurred is specified;

subsequently outputting at least one second graphical representation via which an enlarged representation is output of the region in which the error has occurred; and activating the enlarging via an input.

16. A system for automatic generation of messages in an electrophotographic printer or copier, comprising:

a data processing system that generates at least one first text message that contains at least one error code given occurrence of an error state and which transmits the message to at least one preset recipient; and said error code being associated with each of a plurality of possible error states and the occurred error state being identified with aid of the transferred error code.

17. A system according to claim 16 wherein a preset event occurs when a preset minimum quantity of consumable material is reached, at least one of a preset wear limit of an expendable part being reached or an error state of the electrophotographic printing or copying system occurring.

18. A system according to claim 16 wherein a transfer of the message occurs with aid of an e-mail.

19. A system according to claim 16 wherein a transfer of the message occurs with aid of an SMS message.

20. A system according to claim 16 wherein the message is automatically generated, a sending of the message occurring via an input via an operating unit of the electrophotographic printer or copier.

21. A system according to claim 16 wherein the message contains further specifications or current setting values of the printer or copier that are necessary to determine a cause of the error.

22. A system according to claim 16 wherein the message to be transmitted to an operating unit of the printer or copier be displayed.

23. A system according to claim 16 wherein the message contains at least one of the elements selected from the group consisting of a serial number, an error code, and at least a counter state of the printer or copier.

24. A method for automatic generation of messages in an electrophotographic printer or copier, comprising the steps of:

automatically generating a text message that contains at least an error code with aid of a data processing system after occurrence of a preset error state;

sending the message to a preset recipient; and associating the error code with each of a plurality of possible error states, and identifying the occurred error state with aid of the transferred error code.

* * * * *